US007252915B2

(12) United States Patent
Lee et al.

(10) Patent No.: US 7,252,915 B2
(45) Date of Patent: Aug. 7, 2007

(54) MAGNETIC MONO-COMPONENT TONER COMPOSITION

(75) Inventors: Won-Sup Lee, Daejeon (KR); Chang-Soon Lee, Daejeon (KR); In-Hee Lim, Seoul (KR)

(73) Assignee: LG Chem, Ltd. (KR)

( * ) Notice: Subject to any disclaimer, the term of this patent is extended or adjusted under 35 U.S.C. 154(b) by 161 days.

(21) Appl. No.: 10/500,067

(22) PCT Filed: Dec. 24, 2002

(86) PCT No.: PCT/KR02/02430

§ 371 (c)(1),
(2), (4) Date: Jun. 24, 2004

(87) PCT Pub. No.: WO03/062927

PCT Pub. Date: Jul. 31, 2003

(65) Prior Publication Data

US 2005/0019686 A1 Jan. 27, 2005

(30) Foreign Application Priority Data

Dec. 27, 2001 (KR) ..... 10-2001-0086318

(51) Int. Cl.
*G03G 9/083* (2006.01)

(52) U.S. Cl. ..... 430/106.2; 430/106.1; 430/108.6; 430/108.7

(58) Field of Classification Search ..... 430/106.1, 430/106.3, 108.6, 108.7
See application file for complete search history.

(56) References Cited

U.S. PATENT DOCUMENTS

| | | | | |
|---|---|---|---|---|
| 6,013,406 | A | 1/2000 | Moriki et al. | 430/110 |
| 6,077,636 | A | 6/2000 | Moriki et al. | 430/45 |
| 6,087,059 | A * | 7/2000 | Duggan et al. | 430/108.6 |
| 6,287,739 | B1 * | 9/2001 | Kawakami et al. | 430/108.7 |
| 6,358,656 | B1 * | 3/2002 | Srinivasan et al. | 430/108.6 |
| 6,416,864 | B1 | 7/2002 | Hayashi et al. | 428/403 |

FOREIGN PATENT DOCUMENTS

| | | |
|---|---|---|
| CN | 1150262 | 5/2004 |
| EP | 0 971 273 | 1/2000 |
| JP | 2000-206731 | 7/2000 |
| JP | 2000-292972 | 10/2000 |
| JP | 2001034007 | 2/2001 |
| JP | 2001-281917 | 10/2001 |

OTHER PUBLICATIONS

Diamond, Arthur S & David Weiss (eds.) Handbook of Imaging Materials. New York: Marcel-Dekker, Inc. (Nov. 2001) pp. 178-182.*

PCT International Search Report; International application No. PCT/KR02/02430; International filing date: Dec. 24, 2002; Date of Mailing: Mar. 27, 2003.

PCT International Preliminary Examination Report; International application No. PCT/KR2002/002430; International filing date: Dec. 24, 2002; Date of Completion: Apr. 6, 2004.

European Patent Offic, European Search Report, Date of Completion: Aug. 21, 2006.

CN office action dated Nov. 10, 2006.

Chinese Office Action dated May11, 2007 for Application No. 02824113.4.

* cited by examiner

*Primary Examiner*—Christopher Rodee
(74) *Attorney, Agent, or Firm*—Cantor Colburn LLP

(57) ABSTRACT

The present invention relates to a magnetic mono-component toner composition, and more particularly to a mono-component toner composition that comprises magnetic toner particle comprising a binder resin, a magnetic component, and a charge control agent; a hydrophobic treated silica having a specific surface area of 20 to 80 $m^2/g$; a hydrophobic treated silica having a specific surface area of 130 to 230 $m^2/g$; and a metal oxide fine powder. A magnetic mono-component toner composition of the present invention has such good flowability that it provides smooth toner supply even when the developing roller surface has been worn due to long time use, and it has such excellent uniform chargeability that it prevents image deterioration ("wave" patterns of toner may form on developing roller, that is, magnetic sleeve) by forming an uniform toner layer on the developing roller.

7 Claims, No Drawings

MAGNETIC MONO-COMPONENT TONER COMPOSITION

BACKGROUND OF THE INVENTION (a) Field of the Invention

The present invention relates to a magnetic mono-component toner composition, and more particularly to a magnetic mono-component toner composition having such good flowability that it provides smooth toner supply even when the developing roller surface has been worn due to long time use, and having such excellent uniform chargeability that it prevents image deterioration ("wave" patterns of toner may form on developing roller, that is, magnetic sleeve) by forming an uniform toner layer on the developing roller.

(b) Description of the Related Art

Generally, the dry-type developing methods of the electrophotography can be classified into two-component developing method using a two-component developer comprising a magnetic carrier and a toner, and mono-component developing method using a mono-component developer comprising a toner only without a carrier. In general, the mono-component developing method can realize smaller developing unit, lower manufacturing cost and easy maintenance. Therefore, the number of copiers and printers using the mono-component developing method has been spreading recently, and also the printing speed is improving significantly.

Differing from the two-component developing method using a two-component developer comprising carrier particles that carry toner particle, the flowability of toner particle themselves greatly affects movement of toner in the magnetic mono-component toner.

The non-magnetic mono-component toner applies pressure on the developing roller using a blade made of metal or polymer to control the thickness of toner layer formed on the developing roller, and the two-component toner moves the toner particle by triboelectrification resulting from friction with the carrier particles. In magnetic mono-component developer, on the other hand, a toner regulating member (doctor blade) is arranged so as to make contact with a developing roller, and the mono-component toner is triboelectrically charged by passing between toner regulating member and developing roller, and the charged toner is maintained on the surface of the developing roller by electrostatic force.

Accordingly, enough flowability to easily transport to the toner regulating member is required for a magnetic mono-component toner. If the surface of the developing roller (sleeve) is worn by long time use, that is, if the sleeve surface becomes relatively smooth, the triboelectrification becomes non-uniform and the toner particle may agglomerate to form a wave pattern on the surface of the developing roller, and thereby cause image deterioration.

To solve this problem, a method of reducing folwability of the toner to increase pressure applied to the toner when it passes through the toner regulating member and to reduce formation of the wave pattern has been developed. However, this method inevitably worsens supply of toner and makes it impossible to obtain an uniform image density.

Accordingly, research on a magnetic mono-component toner having such good flowability that the toner is supplied without problems, and having such excellent uniform chargeability that an uniform toner layer is formed on the developing roller even after long time use, are highly required.

SUMMARY OF THE INVENTION

An object of the present invention is to provide a magnetic mono-component toner composition having such good flowability that toner is supplied without problems, and having such excellent uniform chargeability that a uniform toner layer is formed on the developing roller even after long time use, which can prevent image deterioration due to a wave pattern on the sleeve.

In order to attain this object, the present invention provides a magnetic mono-component toner composition comprising:

a) magnetic toner particle comprising i) a binder resin, ii) a magnetic component, and iii) a charge control agent;

b) a hydrophobic treated silica having a specific surface area of 20 to 80 $m^2/g$;

c) a hydrophobic treated silica having a specific surface area of 130 to 230 $m^2/g$; and d) a metal oxide fine powder.

DETAILED DESCRIPTION OF THE PREFERRED EMBODIMENTS

Hereinafter, the present invention is described in more detail.

The present inventors worked on a magnetic mono-component toner having excellent flowability and offering a uniform image. In doing so, they identified that if two species of hydrophobic silica having different specific surface areas are attached to magnetic toner particle, flowability can be improved and wave pattern formation on the developing roller due to insufficient triboelectrification can be prevented.

The present invention relates to a magnetic mono-component toner composition, which comprises magnetic toner particle comprising a binder resin, a magnetic component, and a charge control agent; a hydrophobic treated silica having a specific surface area of 20 to 80 $m^2/g$; a hydrophobic treated silica having a specific surface area of 130 to 230 $m^2/g$; and a metal oxide fine powder.

In the present invention, the binder resin may be used known resin materials for fixing. Particularly, a resin obtained by condensation or addition polymerization of alcohol components and carboxylic acid components is preferred. Preferably, the binder resin may be used from 30 to 80 wt % for the magnetic toner particle.

For the alcohol components, a diols or polyhydric alcohol or alcohol derivatives, such as ethylene glycol, diethylene glycol, triethylene glycol, polyethylene glycol, propylene glycol, butanediol, pentanediol, hexanediol, cyclohexane dimethanol, xylene glycol, bisphenol A, bisphenol A ethylene oxide, bisphenol A propylene oxide, sorbitol, and glycerin can be used alone or in combination. For the carboxylic acid components, a ploybasic carboxylic acid or, carbonic acid derivatives, or a carboxylic anhydrides, such as maleic acid, fumaric acid, phthalic acid, isophthalic acid, terephthalic acid, succinic acid, adipic acid, trimellitic acid, cyclopentane dicarboxylic acid, succinic anhydride, trimellitic anhydride, and maleic anhydride, can be used alone or in combination.

For the binder resin, preferably, acrylates, such as polyester, poly(methyl acrylate), poly(ethyl acrylate), poly(butyl acrylate), poly(2-ethylhexyl acrylate), and poly(lauryl acrylate); methacrylates, such as poly(methyl methacrylate), poly(butyl methacrylate), poly(hexyl methacrylate), poly(2-ethylhexyl methacrylate), and poly(lauryl methacrylate); a copolymer of acrylates and methacrylates; a copolymer of a styrene monomer and acrylates or methacrylates; an ethylene polymer and a copolymer thereof, such as poly(vinyl acetate), poly(vinyl propionate), poly(vinyl lactate), polyethylene, and polypropylene; a styrene copolymer, such as a styrene butadiene copolymer, a styrene isoprene copolymer, and a styrene maleic acid copolymer; poly(vinyl ether); poly(vinyl ketone); polyamide; polyurethane; rubber; epoxy resin; poly(vinyl butyral) rosin; modified rosin; phenol resin; and so forth are used alone or in combination. More preferably, polyester is used.

For the magnetic component, a ferromagnetic element, alloys, or mixtures thereof, a polyhedral type magnetic component, or an acicular type magnetic component can be used. Specifically, magnetite, hematite, ferrite, iron, cobalt, nickel, manganese, alloys or mixtures thereof, ferromagnetic alloys, or a magnetic oxide can be used. Preferably, the magnetic component is a fine powder having an average diameter smaller than 1 μm, and it is preferably used from 20 to 70 wt % of the magnetic toner particle.

For the charge control agent, metal complexes of azo dye compounds or salicylic acid compounds can be used for a negative charged toner, and nigrosine dye or quaternary ammonium salts can be used for a positive charged toner. The content of the charge control agent in the toner is not limited, but it is preferably used at 0.15 to 4 wt % of the magnetic toner particle.

A release agent may be added to prevent offset of the magnetic mono-component toner particle. For the release agent, a variety of waxes and low-molecular-weight olefin resins can be used. To be specific, preferably, an olefin resin like polypropylene, polyethylene, and propylene-ethylene copolymer is used, and more preferably, polypropylene is used. Preferably, the release agent is used at 0.05 to 5 wt % for 100 wt % of the binder resin.

The average diameter of the toner particle is not particularly limited, but toner particle having an average diameter of 5 to 30 μm are preferably used. The toner particle may be prepared by melt blending/pulverization or polymerization.

The hydrophobic treated silica having a specific surface area of 20 to 80 $m^2/g$ prevents uniform triboelectrification due to agglomeration of toner particle, and improves uniform triboelectrification by making the toner passing the toner regulating member spread uniformly. Preferably, the specific surface area of the hydrophobic treated silica is from 20 to 80 $m^2/g$, and more preferably, from 30 to 50 $m^2/g$.

The hydrophobic treated silica having a specific surface area of 130 to 230 $m^2/g$ increases flowability, so that the toner rapidly transfer to the toner regulating member. As a result, unevenness of image density can be prevented. Preferably, the specific surface area of the hydrophobic treated hydrophobic silica is from 130 to 230 $m^2/g$, and more preferably, from 150 to 200 $m^2/g$.

Even when using b) the hydrophobic treated silica having a specific surface area of 20 to 80 $m^2/g$, if the specific surface area of c) the hydrophobic treated silica is below 130 $m^2/g$, flowability of the toner does not improve much, and uneven may form on the solid images due to unevenness of the toner layer if many solid images are printed. Otherwise, if the specific surface area exceeds 230 $m^2/g$, the hydrophobic silica having large specific surface area embeded to the surface of the toner particle, so that flowability of the toner does not improve much.

In addition, even when using c) the hydrophobic treated silica having a specific surface area of 130 to 230 $m^2/g$, if the specific surface area of b) the hydrophobic treated hydrophobic silica is below 20 $m^2/g$, wave pattern may form on the developing roller surface due to agglomeration of the toner particle. This may cause image deterioration by forming a wave pattern on the printed image. Otherwise, if it exceeds 80 $m^2/g$, pressure applied to the toner when it passes through the toner regulating member may be lowered due to hydrophobic silica having small specific surface area. As a result, frictional electrification may be insufficient, and image density may be reduced.

Preferably, c) the hydrophobic treated silica having a specific surface area of 130 to 230 $m^2/g$ is attached to the surface of the toner particle in a larger amount than b) the hydrophobic treated silica having a specific surface area of 20 to 80 $m^2/g$. More preferably, the hydrophobic treated silica having a specific surface area of 20 to 80 $m^2/g$ is used at 0.5 to 1.5 wt % and the hydrophobic treated silica having a specific surface area of 130 to 230 $m^2/g$ is used at 0.5 to 2.5 wt % for 100 wt % of the toner particle.

If the hydrophobic silica having the smaller specific surface area is used in a larger amount than the hydrophobic silica having the larger specific surface area, frictional electrification may become unevenness and the image density may be reduced due to insufficient triboelectrification of the toner.

Even when c) the hydrophobic treated silica having a specific surface area of 130 to 230 $m^2/g$ is used at 0.5 to 2.5 wt % for 100 wt % of the toner particle, if b) the hydrophobic treated silica having a specific surface area of 20 to 80 $m^2/g$ is used at less than 0.5 wt %, a wave pattern may form on the developing roller surface due to agglomeration of the toners. Otherwise, if it is used at more than 1.5 wt %, extra silica not attached to the surface of the toner particle reduces fusing ability at fixing and fusing process in electrophotographic processes.

Additionally, even when b) the hydrophobic treated silica having a specific surface area of 20 to 80 $m^2/g$ is used at 0.5 to 1.5 wt % for 100 wt % of the toner particle, if c) the hydrophobic treated silica having a specific surface area of 130 to 230 $m^2/g$ is used at less than 0.5 wt %, image density becomes nonuniform because the toner transfer to the toner regulating member becomes difficult due to insufficient flowability. Otherwise, if it is used at more than 2.5 wt %, frictional electrification is insufficient when the toner passes through the toner regulating member, and therefore image blurring or a decrease in image density appears.

Hydrophobic treatment can be done by coating or attaching a silane coupling agent or silicone oil to the silica particles.

For the silane coupling agent, dimethyldichlorosilane, trimethylchlorosilane, methyltrichlorosilane, arylphenyldichlorosilane, benzyldimethylchlorosilane, bromomethyldimethylchlorosilane, p-chlorophenyltrichlorosilane, 3-chloropropyltrimethoxysilane, vinyltriethoxysilane, vinyltriacetoxysilane, divinylchlorosilane, or hexamethylenedisilazane can be used.

Also, silicone oil can be used for hydrophobic treatment to reduce fogging (image deterioration due to transfer of toner to non-image area). For example, dimethylsilicone oil, methylphenylsilicone oil, methylhydrogen silicone oil, alkyl modified silicone oil, fluorine modified silicone oil, alcohol modified silicone oil, amino modified silicone oil, epoxy modified silicone oil, epoxy/polyether modified silicone oil, phenol modified silicone oil, carboxyl modified silicone oil, mercapto modified silicone oil, and so forth having a viscosity of 50 to 10000 cps (centipoise) at 25° C. can be used.

The hydrophobic treatment can be done by adsorbing silicone oil on the inorganic powder surface. For example, silica is put in a mixer, silicone oil diluted in a solvent is sprayed into the mixer, and the silica is then heated and dried in the mixer while continuing to agitate by magnetic stirrer.

The hydrophobic silica can be adsorbed on the surface of the toner particle using a common mixer, such as a turbine mixer, a Henschel mixer, or a super mixer, or by using surface modification equipment (Nara Hybridization System; Nara MFG Co.). The hydrophobic silica may be adsorbed on the toner particle weakly or strongly with part of it embeded in the surface thereof.

The present invention uses two kinds of hydrophobic silica, each having a different specific surface area, that is, b) the hydrophobic treated silica having a specific surface area of 20 to 80 $m^2/g$, and c) the hydrophobic treated silica having area of 130 to 230 $m^2/g$, to prevent nonuniform electrification and wave pattern formation on the sleeve surface by smooth the surface and preventing agglomeration of toner particle, and thereby prevents image deterioration due to wave patterns.

The metal oxide fine powder prevents the toner from adsorbing on the photoconductive drum surface when many images are printed for a long time, and greatly improves the PCR(Primary Charge Roller) contamination.

Preferably, the average particle diameter of the metal oxide fine powder is from 50 to 500 nm, and more preferably, 60 to 300 nm. If the average particle diameter is below 50 nm or over 500 nm, flowability and durability is remarkably decreased.

For the metal oxide fine powder, titanium dioxide, aluminum oxide, zinc oxide, magnesium oxide, cerium oxide, iron oxide, copper oxide, tin oxide, and so forth can be used. Considering modification and availability, titanium dioxide is preferable. It is more preferable to use pure titanium dioxide including tin than not including tin.

Preferably, the metal oxide fine powder is used at 0.3 to 1.5 wt % for 100 wt % of the toner particle, and more preferably at 0.5 to 1.2 wt %. If the content is below 0.3 wt %, the durability cannot be improved, and if it exceeds 1.5 wt %, the fusing ability may be reduced.

In the present invention, the specific surface area of the silica refers to a value determined by the BET method. It can be measured with commercially available high-precision automatic gas absorption equipment, etc. This equipment uses inert gas, particularly nitrogen gas, as an adsorption gas to measure the BET specific surface area (S; $m^2/g$) from the gas adsorption amount required to form a single molecular layer on the surface of the hydrophobic silica particles.

Hereinafter, the present invention is described in more detail through Examples and Comparative Examples. However, the following Examples are only for the understanding of the present invention, and the present invention is not limited by the following Examples.

EXAMPLES

Example 1

(Preparation of Toner Particle)

100 wt % of polyester resin as a binder resin, 95 wt % of iron oxide as a magnetic component, 2 wt % of organo-azo complex as a charge control agent, and 5 wt % of low-molecular-weight polypropylene as a release agent were mixed in a Henschel mixer. The above mixed ingredients were melt kneaded through a twin-screw extruder heated at 165° C. It was then crushed with a jet mill and classified with a pneumatic classifier to obtain toner particle having a weight-average particle diameter of 6.7 μm.

(Preparation of Magnetic Mono-Component Toner Composition)

For 100 wt % of the toner particle, 1.0 wt % of hydrophobic silica having a specific surface area of 20 $m^2/g$ treated with hexamethyldisilazane (HMDS), 0.5 wt % of hydrophobic silica having a specific surface area of 130 $m^2/g$ treated with dimethyl silicone oil, and titanium dioxide having an average particle diameter of 120 nm as a metal oxide fine powder were mixed in a Henschel mixer for 3 minutes. The mixture was attached onto the surface of the toner particle to obtain a magnetic mono-component toner composition.

Examples 2 to 54 and Comparative Examples 1 to 10

The procedure of Example 1 was carried out with the content and compositions shown in the following Table 1.

TABLE 1

| | Hydrophobic silica having a specific surface area of 20 to 80 $m^2/g$ | | Hydrophobic silica having a specific surface area of 130 to 230 $m^2/g$ | |
|---|---|---|---|---|
| Classification | Specific surface area | Content (wt %) | Specific surface area | Content (wt %) |
| Example 2 | 130 | 1.0 | 20 | 0.5 |
| Example 3 | 130 | 1.0 | 20 | 1.0 |
| Example 4 | 130 | 2.5 | 20 | 0.5 |
| Example 5 | 130 | 2.5 | 20 | 1.0 |
| Example 6 | 130 | 2.5 | 20 | 1.5 |
| Example 7 | 180 | 0.5 | 20 | 0.5 |
| Example 8 | 180 | 1.0 | 20 | 0.5 |
| Example 9 | 180 | 1.0 | 20 | 1.0 |
| Example 10 | 180 | 2.5 | 20 | 0.5 |
| Example 11 | 180 | 2.5 | 20 | 1.0 |
| Example 12 | 180 | 2.5 | 20 | 1.5 |
| Example 13 | 230 | 0.5 | 20 | 0.5 |
| Example 14 | 230 | 1.0 | 20 | 0.5 |
| Example 15 | 230 | 1.0 | 20 | 1.0 |
| Example 16 | 230 | 2.5 | 20 | 0.5 |
| Example 17 | 230 | 2.5 | 20 | 1.0 |
| Example 18 | 230 | 2.5 | 20 | 1.5 |
| Example 19 | 130 | 0.5 | 40 | 0.5 |
| Example 20 | 130 | 1.0 | 40 | 0.5 |
| Example 21 | 130 | 1.0 | 40 | 1.0 |
| Example 22 | 130 | 2.5 | 40 | 0.5 |
| Example 23 | 130 | 2.5 | 40 | 1.0 |
| Example 24 | 130 | 2.5 | 40 | 1.5 |
| Example 25 | 180 | 0.5 | 40 | 0.5 |
| Example 26 | 180 | 1.0 | 40 | 0.5 |
| Example 27 | 180 | 1.0 | 40 | 1.0 |
| Example 28 | 180 | 2.5 | 40 | 0.5 |
| Example 29 | 180 | 2.5 | 40 | 1.0 |
| Example 30 | 180 | 2.5 | 40 | 1.5 |
| Example 31 | 230 | 0.5 | 40 | 1.5 |
| Example 32 | 230 | 1.0 | 40 | 0.5 |
| Example 33 | 230 | 1.0 | 40 | 1.0 |
| Example 34 | 230 | 2.5 | 40 | 0.5 |
| Example 35 | 230 | 2.5 | 40 | 1.0 |
| Example 36 | 230 | 2.5 | 40 | 1.5 |
| Example 37 | 130 | 0.5 | 80 | 0.5 |
| Example 38 | 130 | 1.0 | 80 | 0.5 |
| Example 39 | 130 | 1.0 | 80 | 1.0 |
| Example 40 | 130 | 2.5 | 80 | 0.5 |
| Example 41 | 130 | 2.5 | 80 | 1.0 |
| Example 42 | 130 | 2.5 | 80 | 1.5 |
| Example 43 | 180 | 0.5 | 80 | 0.5 |
| Example 44 | 180 | 1.0 | 80 | 0.5 |
| Example 45 | 180 | 1.0 | 80 | 1.0 |
| Example 46 | 180 | 2.5 | 80 | 0.5 |
| Example 47 | 180 | 2.5 | 80 | 1.0 |
| Example 48 | 180 | 2.5 | 80 | 1.5 |
| Example 49 | 230 | 0.5 | 80 | 0.5 |
| Example 50 | 230 | 1.0 | 80 | 0.5 |

TABLE 1-continued

| Classification | Hydrophobic silica having a specific surface area of 20 to 80 $m^2/g$ | | Hydrophobic silica having a specific surface area of 130 to 230 $m^2/g$ | |
|---|---|---|---|---|
| | Specific surface area | Content (wt %) | Specific surface area | Content (wt %) |
| Example 51 | 230 | 1.0 | 80 | 1.0 |
| Example 52 | 230 | 2.5 | 80 | 0.5 |
| Example 53 | 230 | 2.5 | 80 | 1.0 |
| Example 54 | 230 | 2.5 | 80 | 1.5 |
| Comp. Example 1 | 180 | 1.0 | 20 | 0.4 |
| Comp. Example 2 | 180 | 1.0 | 20 | 16 |
| Comp. Example 3 | 180 | 0.4 | 40 | 1.0 |
| Comp. Example 4 | 180 | 2.6 | 40 | 1.0 |
| Comp. Example 5 | — | — | 40 | 0.5 |
| Comp. Example 6 | — | — | 40 | 1.0 |
| Comp. Example 7 | — | — | 40 | 1.5 |
| Comp. Example 8 | 180 | 0.5 | — | — |
| Comp. Example 9 | 180 | 1.0 | — | — |
| Comp. Example 10 | 180 | 2.5 | — | — |

Test Example

Magnetic mono-component toner compositions prepared in Examples 1 to 54 and Comparative Examples 1 to 10 were used to print 5,000 sheets of paper using a non-contact, magnetic mono-component developing type printer (LaserJet 4000; Hewlett-Packard Company) under normal temperature and humidity (20° C.; 55±5% RH). The image density, fogging, wave pattern, and PCR contamination were determined by the following method. The results are shown in the following Table 2.

a) Image density (I.D)—Solid area image was determined with a Macbeth reflection densitometer RD918 (I.D value larger than 1.30 is approved).

b) Fogging (background)—The non-image area was observed with an optical microscope.

○: No fogging was observed.

Δ: Obscure fogging was observed.

x: Clear fogging was observed.

c) Wave pattern—Magnetic mono-component toners prepared in Examples 1 to 54 and Comparative Examples 1 to 10 were used to print half-tone images on 100 sheets of paper. The printed half-tone images and surface of the developing sleeve were observed by eye.

○: No wave pattern.

Δ: Wave pattern was observed on page 1, but disappeared on page 100.

x: Wave pattern was observed on all pages.

d) PCR contamination (contamination of developing drum)—A transparent tape was attached to the toner remaining on the POR surface after transferring. The tape was observed with an optical microscope.

○: No PCR contamination was observed.

Δ: Obscure PCR contamination was observed.

x: Clear PCR contamination was observed.

TABLE 2

| Classification | Image Density | Fogging | Wave Pattern | PCR Contamination |
|---|---|---|---|---|
| Example 1 | 1.35 | ○ | Δ | Δ |
| Example 2 | 1.38 | ○ | ○ | Δ |
| Example 3 | 1.42 | Δ | ○ | Δ |
| Example 4 | 1.39 | ○ | Δ | ○ |
| Example 5 | 1.43 | ○ | ○ | ○ |
| Example 6 | 1.45 | Δ | ○ | ○ |
| Example 7 | 1.48 | ○ | Δ | ○ |
| Example 8 | 1.51 | ○ | ○ | ○ |
| Example 9 | 1.52 | Δ | ○ | ○ |
| Example 10 | 1.33 | ○ | ○ | Δ |
| Example 11 | 1.34 | ○ | ○ | Δ |
| Example 12 | 1.37 | Δ | ○ | Δ |
| Example 13 | 1.35 | ○ | Δ | ○ |
| Example 14 | 1.39 | ○ | ○ | ○ |
| Example 15 | 1.41 | Δ | ○ | ○ |
| Example 16 | 1.43 | ○ | Δ | ○ |
| Example 17 | 1.45 | ○ | ○ | ○ |
| Example 18 | 1.46 | Δ | ○ | ○ |
| Example 19 | 1.33 | ○ | ○ | Δ |
| Example 20 | 1.35 | ○ | ○ | Δ |
| Example 21 | 1.37 | Δ | ○ | ○ |
| Example 22 | 1.36 | ○ | ○ | Δ |
| Example 23 | 1.38 | ○ | ○ | Δ |
| Example 24 | 1.39 | Δ | ○ | ○ |
| Example 25 | 1.41 | ○ | Δ | ○ |
| Example 26 | 1.42 | ○ | ○ | ○ |
| Example 27 | 1.44 | Δ | ○ | ○ |
| Example 28 | 1.32 | ○ | Δ | ○ |
| Example 29 | 1.34 | ○ | ○ | ○ |
| Example 30 | 1.36 | Δ | ○ | ○ |
| Example 31 | 1.35 | ○ | ○ | Δ |
| Example 32 | 1.37 | ○ | ○ | Δ |
| Example 33 | 1.38 | Δ | ○ | Δ |
| Example 34 | 1.40 | ○ | Δ | ○ |
| Example 35 | 1.43 | ○ | ○ | ○ |
| Example 36 | 1.45 | Δ | ○ | ○ |
| Example 37 | 1.31 | ○ | Δ | ○ |
| Example 38 | 1.32 | ○ | ○ | ○ |
| Example 39 | 1.35 | Δ | ○ | ○ |
| Example 40 | 1.34 | ○ | Δ | ○ |
| Example 41 | 1.36 | ○ | ○ | Δ |
| Example 42 | 1.38 | Δ | ○ | ○ |
| Example 43 | 1.42 | ○ | ○ | ○ |
| Example 44 | 1.45 | ○ | ○ | ○ |
| Example 45 | 1.50 | Δ | ○ | ○ |
| Example 46 | 1.33 | ○ | Δ | ○ |
| Example 47 | 1.35 | ○ | ○ | ○ |
| Example 48 | 1.37 | ○ | ○ | ○ |
| Example 49 | 1.35 | ○ | Δ | ○ |
| Example 50 | 1.38 | ○ | ○ | ○ |
| Example 51 | 1.39 | Δ | ○ | ○ |
| Example 52 | 1.43 | ○ | Δ | ○ |
| Example 53 | 1.46 | ○ | ○ | Δ |
| Example 54 | 1.49 | ○ | ○ | ○ |
| Comp. Example 1 | 1.35 | Δ | X | X |
| Comp. Example 2 | 1.43 | X | X | Δ |
| Comp. Example 3 | 1.32 | Δ | X | X |
| Comp. Example 4 | 1.50 | X | X | Δ |
| Comp. Example 5 | 1.44 | Δ | X | ○ |
| Comp. Example 6 | 1.32 | X | X | ○ |
| Comp. Example 7 | 1.45 | Δ | X | ○ |
| Comp. Example 8 | 1.30 | X | X | ○ |
| Comp. Example 9 | 1.40 | Δ | X | ○ |
| Comp. Example 10 | 1.29 | X | X | Δ |

As seen in Table 2, magnetic mono-component toner compositions prepared in Examples 1 to 54, which comprise magnetic toner particle comprising a binder resin, a magnetic component, and a charge control agent; a hydrophobic treated silica having a specific surface area of 20 to 80 $m^2/g$; a hydrophobic treated silica having a specific surface area of 130 to 230 $m^2/g$; and a metal oxide fine powder according to the present invention, show a sufficient image density (I.D) of over 1.30 and have less image fogging (background), image deterioration due to wave pattern on the developing roller surface, and PCR contamination. On the contrary, magnetic toners prepared in Comparative Examples 1 to 10 show severe image deterioration due to wave patterns and image fogging.

As seen above, a magnetic mono-component toner composition of the present invention has such a good flowability so as to provide smooth toner supply even when the developing roller surface has become worn due to long time use, and it has such excellent uniform chargeability that it prevents image deterioration by forming a uniform toner layer on the developing roller.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A magnetic mono-component toner composition, which comprises:

a) 100 parts by weight of magnetic toner particle comprising:

i) a binder resin in an amount of 30 to 80 wt % of the magnetic toner particle;

ii) a magnetic component in an amount of 20 to 70 wt % of the magnetic toner particle; and iii) a charge control agent in an amount of 0.15 to 4 wt % of the magnetic toner particle;

b) 0.5 to 1.5 parts by weight of a hydrophobic treated silica having a specific surface area of 20 to 80 $m^2/g$;

c) 0.5 to 2.5 parts by weight of a hydrophobic treated silica having a specific surface area of 130 to 230 $m^2/g$; and d) 0.3 to 1.5 parts by weight of a metal oxide fine powder based on the magnetic toner particle, wherein d) the metal oxide fine powder is one or more mixtures selected from a group consisting of titanium dioxide, zinc oxide, magnesium oxide, cerium oxide, iron oxide, copper oxide, and tin oxide.

2. The magnetic mono-component toner composition according to claim 1, wherein a) i) the binder resin is one or more selected from the group consisting of polyester, poly (methyl acrylate), poly(ethyl acrylate), poly(butyl acrylate), poly(2-ethylhexyl acrylate), poly(lauryl acrylate), poly(methyl methacrylate), poly(butyl methacrylate), poly(hexyl methacrylate), poly(2-ethylhexyl methacrylate), poly(lauryl methacrylate), a copolymer of acrylates and methacrylates, a copolymer of a styrene monomer and acrylates or methacrylates, poly(vinyl acetate), poly(vinyl propionate), poly (vinyl lactate), polyethylene, polypropylene, a styrene butadiene copolymer, a styrene isoprene copolymer, a styrene maleic acid copolymer, poly(vinyl ether), poly(vinyl ketone), polyamide, polyurethane, rubber, epoxy resin, poly (vinyl butyral) rosin, a modified rosin, and a phenol resin, which are obtained by condensation or addition polymerization of alcohol components and carboxylic acid components.

3. The magnetic mono-component toner composition according to claim 1, wherein a) ii) the magnetic component is one or more selected from the group consisting of alloys or mixtures of magnetite, hematite, ferrite, iron, cobalt, nickel, or manganese; ferromagnetic alloys; and a magnetic oxide.

4. The magnetic mono-component toner composition according to claim 1, wherein a) iii) the charge control agent is a metal complex azo dye or a salicylic acid compound for a negative charged toner, and a nigrosine dye or a quaternary ammonium salt for a positive charged toner.

5. The magnetic mono-component toner composition according to claim 1, wherein a) the magnetic mono-component toner particle further comprise iv) 0.05 to 5 parts by weight of release agent for 100 parts by weight of the binder resin.

6. The magnetic mono-component toner composition according to claim 1, wherein average diameter of a) the toner particle is 5 to 30 μm.

7. The magnetic mono-component toner composition according to claim 1, wherein b) the hydrophobic treated silica having a specific surface area of 20 to 80 $m^2/g$ and c) the hydrophobic treated silica having a specific surface area of 130 to 230 $m^2/g$ are hydrophobic treated by coating or attaching a silane coupling agent or silicone oil on the silica particles.

* * * * *